US009856710B2

(12) United States Patent
Zhu et al.

(10) Patent No.: US 9,856,710 B2
(45) Date of Patent: Jan. 2, 2018

(54) TUBE ARRANGEMENT TO ENHANCE SEALING BETWEEN TUBULAR MEMBERS

(71) Applicant: Vetco Gray Inc., Houston, TX (US)

(72) Inventors: Baozhi Zhu, Houston, TX (US); Jeffrey Allen Raynal, Houston, TX (US); Nicholas Peter Gette, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 248 days.

(21) Appl. No.: 14/068,421

(22) Filed: Oct. 31, 2013

(65) Prior Publication Data

US 2015/0114666 A1 Apr. 30, 2015

(51) Int. Cl.

| | |
|---|---|
| ***E21B 33/03*** | (2006.01) |
| ***E21B 33/04*** | (2006.01) |
| *E21B 33/00* | (2006.01) |

(52) U.S. Cl.

CPC ..... *E21B 33/03* (2013.01); *E21B 33/04* (2013.01); *E21B 2033/005* (2013.01)

(58) Field of Classification Search

CPC ..... E21B 2033/005

See application file for complete search history.

(56) References Cited

U.S. PATENT DOCUMENTS

| | | | | |
|---|---|---|---|---|
| 3,712,631 | A * | 1/1973 | Forchini | F16L 21/035 277/605 |
| 3,980,311 | A * | 9/1976 | Ditcher | E02D 29/12 277/605 |
| 4,662,663 | A * | 5/1987 | Schmitz | B21D 39/04 285/382.5 |
| 4,749,047 | A * | 6/1988 | Taylor | E21B 33/04 166/182 |
| 4,892,149 | A * | 1/1990 | Hoes | E21B 29/10 166/208 |
| 6,948,715 | B2 * | 9/2005 | Taylor | F16J 15/164 277/331 |
| 8,245,776 | B2 | 8/2012 | Gette | |
| 8,312,922 | B2 | 11/2012 | Nelson | |
| 8,500,127 | B2 | 8/2013 | Gette | |
| 2013/0056196 | A1 * | 3/2013 | Hench | E21B 33/043 166/88.1 |
| 2013/0140775 | A1 | 6/2013 | Raynal et al. | |

OTHER PUBLICATIONS

PCT Search Report and Written Opinion issued in connection with corresponding Application No. PCT/US2014/061496 dated Sep. 23, 2015.

* cited by examiner

*Primary Examiner* — David L Andrews
*Assistant Examiner* — Michael A Goodwin
(74) *Attorney, Agent, or Firm* — Hogan Lovells US LLP

(57) ABSTRACT

An well assembly having a housing with an inner surface, the assembly including a tubular member inserted in the housing and having an outer surface. The assembly further includes a plurality of protrusions extending from one of the inner or outer surfaces, the protrusions separated by gaps defined between adjacent protrusions. In addition, the well assembly includes a metal to metal seal pressed against and deformed by the protrusions. A plurality of hollow tubes are provided for insertion in the gaps between the protrusions, the tubes being collapsible upon engagement with the metal to metal seal.

8 Claims, 3 Drawing Sheets

TUBE ARRANGEMENT TO ENHANCE SEALING BETWEEN TUBULAR MEMBERS

BACKGROUND OF THE INVENTION

1. Field of the Invention

This technology relates to oil and gas wells, and in particular to a well component having a sealing profile that includes engaging protrusions with collapsible tubes therebetween.

2. Brief Description of Related Art

Typical oil and gas wells include multiple components, such as, for example, wellheads, annular seals, and tubing hangers. During some phases of operation, it is desirable to seal the interfaces between the well components to prevent fluids from passing between the well components. To increase the ability of components to seal together, some well components are equipped with protrusions, sometimes referred to as wickers, on at least one of adjacent components. These protrusions serve to engage with the surface of an adjacent well member to increase sealing between the well components.

One problem with the use of such protrusions to enhance sealing is hydraulic lock. Hydraulic lock occurs when well fluid fills the valleys between the protrusions and becomes trapped when the protrusions engage an adjacent well component surface. Because most well fluid is not compressible, the fluid filled valleys prevent or restrict movement of the protrusions toward an opposing surface. To eliminate this problem, different technologies have been used.

One such technology includes the use of collapsible foam, which fills the valleys, displacing the well fluid therefrom. The foam typically consists of a large quantity of small hollow balls, or glass beads, which are collapsible when compressed. As the protrusions engage an opposing surface, the foam is crushed by the opposing surface. The use of collapsible foam, however, can be problematic. For example, the small glass beads are difficult to embed on the valleys between protrusions, requiring a special coating process during the manufacturing of the well components. Furthermore, as the beads are crushed, the crushed pieces of the beads accumulate in the bottom of the valleys, ultimately filling the valleys enough that the "bite" between the protrusions and an opposing surface is impeded.

SUMMARY OF THE INVENTION

Disclosed herein is an assembly for overcoming hydraulic pressure between components in a well. The assembly has a housing with an inner surface, and a tubular member inserted in the housing and having an outer surface. A plurality of protrusions, separated by gaps or valleys, extends from the inner and/or outer surfaces, and engage an opposing surface upon energization of the tubular member. A metal to metal seal is pressed against and deformed by the intrusions. A plurality of hollow tubes is positioned in the gaps or valleys between the protrusions, and are designed to collapse as the protrusions engage the metal to metal seal.

Also disclosed herein is a method of forming a wellhead assembly having an outer wellhead member and an inner wellhead member, and a curved surface with protrusions that extend from surfaces of either the outer or inner wellhead member toward the other of the outer or inner wellhead member. The method includes retaining compressible fluid in gaps between the protrusions, and sealing an annulus adjacent the curved surface by urging a seal against the protrusions that compresses the compressible fluid.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE PREFERRED EMBODIMENT

Figure 1:
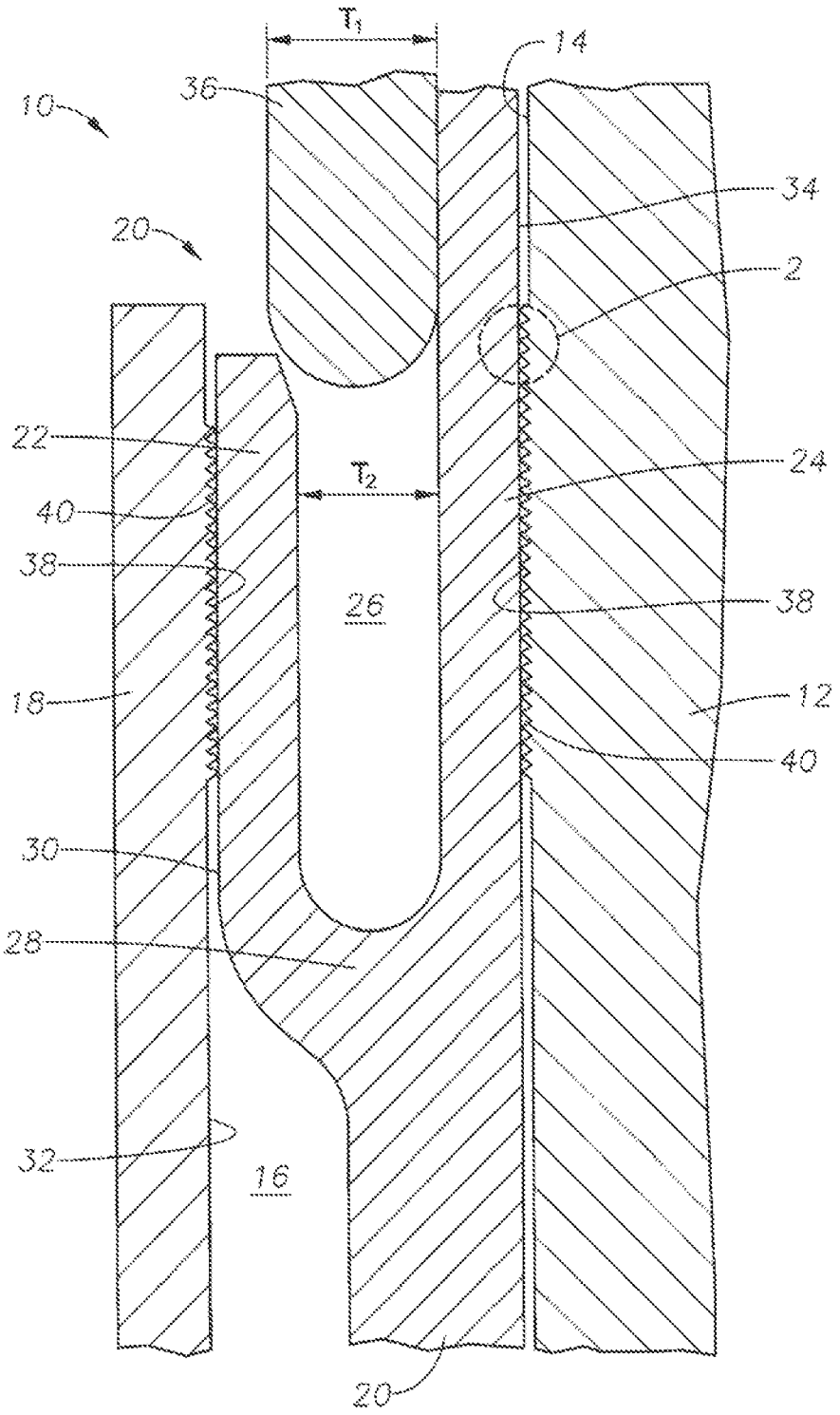
FIG. 1 is a side cross-sectional view of example well components, including sealing protrusions.

The foregoing aspects, features, and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. However, the technology is not intended to be limited to the specific terms used, and it is to be understood that each specific term includes equivalents that operate in a similar manner to accomplish a similar purpose.

FIG. 1 is a side cross-sectional view of a seal assembly 10 according to an embodiment of the present technology. The seal assembly 10 is shown in a wellhead 12 having an inner surface 14 which defines a bore 16. In the embodiment shown, a tubing hanger 18 is positioned in the bore 16 of the wellhead 12. A sealing mechanism 20 is positioned between the wellhead 12 and the tubing hanger 18, and seals the space therebetween to prevent fluid from passing between the wellhead 12 and the tubing hanger 18.

In the embodiment of FIG. 1, the sealing mechanism has a first leg 22 and a second leg 24, which are separated by a sealing mechanism gap 26. The first leg 22 and second leg 24 are joined at bottom ends thereof at an intersection 28. The first and second legs 22, 24 have a thickness that is small enough to allow deflection of the first and second legs 22, 24 toward or away from the tubing hanger 18 and the wellhead 12, respectively.

To seal the gap between the wellhead 12 and the tubing hanger 18, the sealing mechanism 20 is placed in the bore 16 between the wellhead 12 and the tubing hanger 18 so that an inner surface 30 of the inner leg 22 is adjacent the outer surface 32 of the tubing hunger 18, and an outer surface 34 of the outer leg 24 is adjacent the inner surface 14 of the wellhead 12. An energizing element 36 is then inserted into the sealing mechanism gap 26 between the first and second legs 22, 24. The thickness $T_1$ of the energizing element 36 is slightly larger than the width $T_2$ of the sealing element gap 26. As a result, when the energizing element 36 is forced into the sealing element gap 26, it pushes the first and second legs 22, 24 radially apart into respective sealed engagement with the inner surface 14 of the wellhead 12 and the outer surface 32 of the tubing hanger 18 respectively.

In order to enhance the ability of the first and second legs 22, 24 to seal against the wellhead 12 and the tubing hanger 18, the sealing mechanism 20 in the embodiment of FIG. 1 includes protrusions 38 that extend from the tubing hanger 18 or the wellhead 12 toward the sealing mechanism legs 22, 24. In an example, the protrusions 38 circumscribe the respective inner and outer surfaces 14, 32 of the wellhead 12 and tubing hanger 18. Optionally, the protrusions 38 have a chisel-like cross section with upper and lower radial sides that extend obliquely away from surfaces 14, 32 and intersect to form a point distal from the surfaces 14, 32. As the legs 22, 24 are energized and pushed toward the tubing hanger 18 and wellhead 12 the protrusions 38 engage the legs 22, 24, thereby improving the seal between the sealing mechanism 20, and the tubing hanger 18 and wellhead 12. Although the protrusions 38 are shown to be extending from the tubing hanger 18 and wellhead 12 toward the sealing mechanism 20, they could also extend in the opposite direction, from the sealing mechanism 20 toward the tubing hanger 18 or wellhead member 20. In addition, although the protrusions 38 are shown contacting both the first and second legs 22, 24 of the sealing mechanism 20, the protrusions 38 could be provided on only one side of the sealing mechanism 20.

One problem that can occur when using protrusions 38 in conjunction with a sealing mechanism 20 is the problem of hydraulic lock. For example, in a configuration such as that of FIG. 1, where the protrusions 38 extend from the tubing hanger 18 and wellhead 12 toward the sealing mechanism 20, the protrusions 38 typically remain disengaged from the surfaces of the sealing mechanism 20 when the sealing mechanism 20 is not energized. In such a configuration, well fluid fills the space between the sealing mechanism 20 and the tubing hanger 18 and wellhead 12. In particular, well fluid surrounds the protrusions 38 and fills valleys 40 or gaps between the protrusions 38. Upon energization, as the first and second legs 22, 24 of the sealing mechanism 20 approach the tubing hanger 18 and wellhead 12, the inner surface 30 of the first leg 22 contacts the protrusions 38 on the outer surface 32 of the tubing hanger 18, and the outer surface 34 of the second leg 24 contacts the protrusions 38 on the inner surface 14 of the wellhead 12. This contact isolates the valleys 40 between the protrusions 38, which are filled with well fluid. The fluid trapped in the valleys 40 is not compressible, and causes the valleys 40 to become multiple pressurized chambers that push back against the legs 22, 24 of the sealing mechanism 20. This "push back" is known as hydraulic lock, which is an undesirable hydraulic force acting opposite the radial force of the legs 22, 24 when they are energized. In situations where hydraulic lock occurs, energizing the legs 22, 24 requires enough force be applied to overcome the hydraulic lock and sealingly engage with the protrusions 38. Reducing hydraulic look reduces the forces necessary to achieve sealed engagement between the legs 22, 24 and the protrusions 38.

Figure 3:
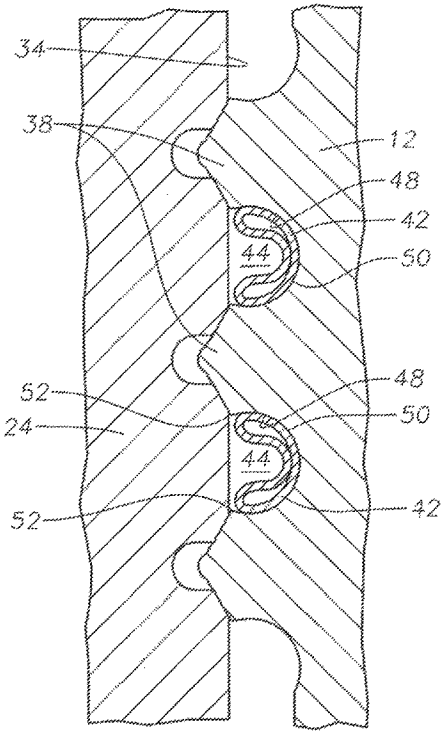
FIG. 3 is an enlarged side cross-sectional view of the protrusions and tubes of FIG. 2 in a collapsed configuration.
Figure 2:
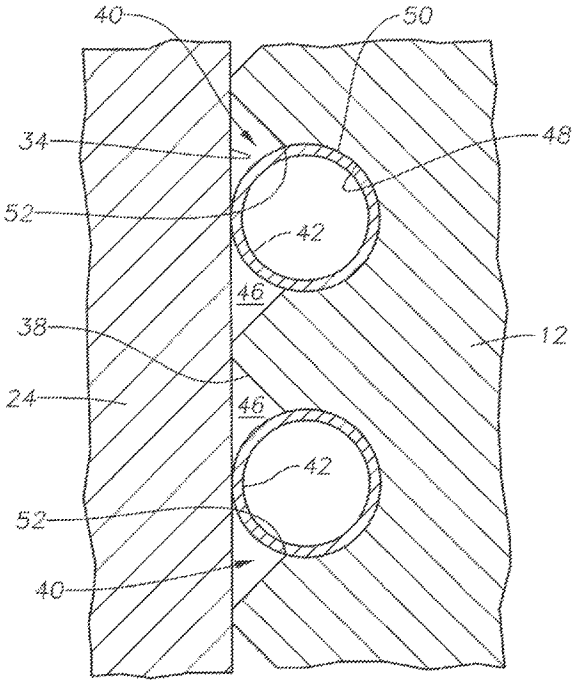
FIG. 2 is an enlarged side cross-sectional view of the protrusions of FIG. 1, and further illustrated are tubes according to an embodiment of the present technology.

Referring to FIG. 2, there is shown an embodiment of the technology designed to eliminate the problem of hydraulic lock by displacing well fluids in the valleys 40 with collapsible tubes 42. In FIG. 2, wellhead 12 is shown positioned adjacent the second leg 24 of the sealing mechanism 20. Protrusions 38 extend from the surface of wellhead 12 toward the sealing mechanism 20. Also shown in FIG. 2 are tubes 42, positioned in valleys 40 between the protrusions 38. One purpose of the tubes 42 is to displace well fluid in the valleys 40 by occupying the space in the valleys 40 between the protrusions 38. The tubes 42 are filled with air, or other compressible fluid, and are designed to collapse as the outside surface 34 of the second leg 24 of the sealing mechanism 20 engages the protrusions 38, as shown in FIG. 3. The collapse of the tubes 42 opens a void 44 in the collapsed portion of the tube 42. The void 44 accepts well fluid that previously filled interstitial spaces 46 (shown in FIG. 2) between the second leg 24 of the sealing mechanism 20 and the protrusions 38. Movement of the well fluid from the interstitial spaces 46 into the voids 44, allows further penetration of the protrusions 38 into the outer surface 34 of the second leg 24 without hydraulic lock.

As shown in FIGS. 2 and 3, in some embodiments the profiles of the valleys 40 between the protrusions 38 may be contoured to accept the tubes 42. For example, where the tubes 42 have circular cross-sections, the bottom of each valley 40 may have a radius 48 that corresponds to, and is in close contact with, the outer surface 50 of the tubes 42, so that there is minimal or no space between the bottom portion of the valleys 40 and the tubes 42. In this configuration, the amount of space in the valleys 40 that is occupied by the tubes 42 can be maximized. Furthermore, the radius 48 may extend more than 180 degrees around the bottom of each valley 40 so that a portion of the protrusions 38 juts axially into the valley 40 proximate its peak, thereby creating indented ridges 52 that allow the tubes 42 to be snapped into place in the valleys 40. In an example, the ridges 52 retain the tubes 42 within the valleys 40.

Although the tubes 42 of FIGS. 2 and 3 are shown to have circular cross sections, it is to be understood that the tubes 42 can have any shape capable of collapsing upon engagement of the protrusions 38 with a well member. In addition, the tubes 42 can be made of any appropriate material, such as, for example, titanium, aluminum, or steel. Optionally, the tubes 42 may be made from a material that is elastic. The stiffness of the material from which the tubes 42 are made can be less than that of the surrounding well components, thereby ensuring the tubes 42 collapse before adjoining components begin to deform. Furthermore, the tubes 42 can have a uniform wall thickness, as shown, or variable wall thickness. Such variable wall thickness can be designed to cause the tubes 42 to collapse in a predetermined way, or at predetermined pressures depending on the individual circumstances of the well in which the tubes 42 are used. In some embodiments, the tubes 42 may have a wall thickness capable of withstanding up to about 15 kips per square inch before collapsing.

In an example of practice, the tubes 42 of the present technology are inserted into the valleys 40 between the protrusions 38 before the system is assembled. After insertion of the tubes 42, the system is assembled so that a first well component, which may be, for example, a wellhead, surrounds a second well component, such as, for example, an annular seal. In alternate embodiments, the first and second well components could be other well components, such as, for example, an annular seal and a tubing hanger. In addition, the protrusions 38 could be located on any surface of either the first or second well components. When the tubes 42 are inserted between the protrusions 38 they substantially fill the valleys 40 between the protrusions 38. Thereafter, one of the wellhead members, such as, for example, the annular seal, can be energized, which cases the protrusions to engage an opposing surface. As the protrusions 38 engage the opposing surface, the opposing surface contacts the tubes 42 and ultimately causes them to collapse. Alter the tubes collapse, the opposing surface can continue to move toward and engage the protrusions 38 without experiencing hydraulic lock.

Figure 5:
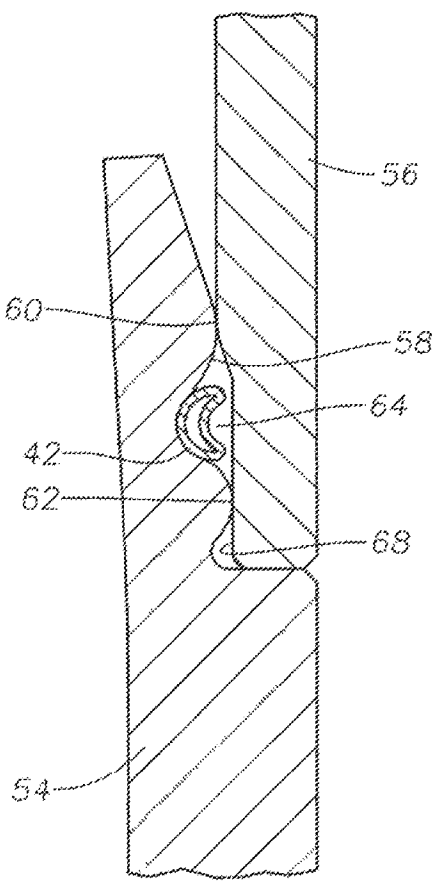
FIG. 5 is an alternate enlarged side cross-sectional view of the example well components of FIG. 4.
Figure 4:
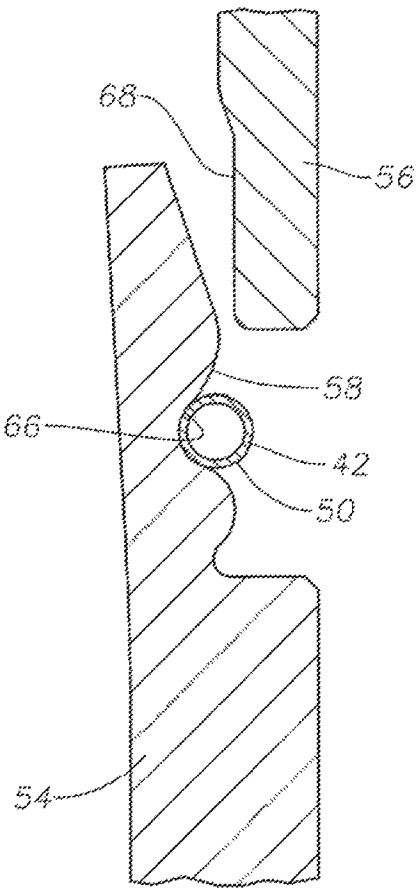
FIG. 4 is an enlarged side cross-sectional view of example well components according to another embodiment of the present technology.

In another example embodiment, shown in FIGS. 4 and 5, a tube 42 can be used to reduce hydraulic lock between a casing hanger 54 and a stab seal 56. In such an embodiment, the stab seal 56 is introduced into the casing hanger 54 and is designed to seal against an inner surface 58 of the casing hanger 54 in upper 60 and lower 62 locations (shown in FIG. 5). As the stab seal 56 is lowered into the casing hanger 54, well fluid can become trapped in a pocket 64 between the stab seal 56 and casing hanger 54, and between the upper and lower sealing locations 60, 62. By positioning a collapsible tube 42 in this pocket 64, hydraulic lock can be reduced or eliminated in the same way as described above with regard to the embodiments of FIGS. 1-3.

For example, as shown in FIG. 4, the tube 42 has an outer surface 50, and the inner surface of the easing hanger 54 can be machined to have a recess 66 that corresponds to the outer surface 50 of the tube 42. In addition, the tube 42 may have a diameter large enough to extend inwardly from the inner surface 58 of the casing hanger 54 into the path of the stab seal 56. As the stab seal 56 is lowered into the casing hanger 54, as shown in FIG. 5, the outer surface 68 of the stab seal 56 contacts and collapses the tube 42, and contacts and seals against the inner surface 58 of the casing hanger 54 at the lower location 62. Thereafter, the stab seal 56 continues to move downward until its outer surface 68 contacts and seals against the inner surface 58 of the easing hanger 54 at the upper location 60. The area occupied by the tube 42, which, as described above, is filled with a compressible fluid, displaces well fluid in the pocket 64 as the outer surface 68 of the stab seal 56 contacts and seals against the inner surface 58 of the casing hanger 54, thereby preventing hydraulic lock.

While the technology has been shown or described in only some of its forms, it should be apparent to those skilled in the art that it is not so limited, but is susceptible to various changes without departing from the scope of the invention. Furthermore, it is to be understood that the above disclosed embodiments are merely illustrative of the principles and applications of the present invention. Accordingly, numerous modifications may be made to the illustrative embodiments and other arrangements may be devised without departing from the spirit and scope of the present invention as defined by the appended claims.

What is claimed is:

1. A well assembly having a first member with an inner surface, the well assembly comprising:

a second member inserted in the first member and having an outer surface;

at least one metal to metal seal between the first member and the second member when the second member is inserted in the first member; and at least one hollow tube attached to at least one of the inner surface or the outer surface, the at least one tube being collapsible upon engagement of the at least one metal to metal seal, the at least one hollow tube being made from a material that is less stiff than the material of the first and second members, and the at least one hollow tube being made of titanium and the first and second members being made of steel.

2. The assembly of claim 1, wherein the at least one hollow tube has an outer surface with outer surface contours, and wherein the surface to which the at least one hollow tube attaches has at least one recess with inner contours, the inner contours of the recess shaped to receive the at least one hollow tube, the outer surface contours of the at least one hollow tube contacting the inner contours of the at least one recess so that there is substantially no space between the outer surface contours of the at least one hollow tube and the inner contours of the at least one recess.

3. The assembly of claim 1, wherein the at least one hollow tube has walls of a thickness to withstand up to about 15 kips per square inch before collapsing.

4. The assembly of claim 1, wherein the inner surface or the outer surface to which the hollow tube is attached is at least partially contoured to the shape of the hollow tube.

5. A wellhead assembly comprising:

a wellhead housing having an inner surface that defines a bore;

an annular seal for insertion in the bore, the annular seal having an outer surface that, when the annular seal is inserted in the bore, is positioned proximate the inner surface of the wellhead housing;

a plurality of protrusions extending inwardly from the inner surface of the wellhead housing for engaging the outer surface of the annular seal to prevent axial movement between the wellhead housing and the annular seal, the protrusions separated by circumferential gaps;

a plurality of circumferential hollow tubes attached to the inner surface of the wellhead housing in the gaps between the protrusions, the tubes being collapsible upon engagement with the outer surface of the annular seal, the hollow tubes being made from a material that is less stiff than the materials of the wellhead housing and the annular seal, and the hollow tubes being made of titanium and the wellhead housing and annular seal being made of steel.

6. The assembly of claim 5, further comprising a tubular inserted in the well housing having protrusions on an outer surface in sealing engagement with the annular seal, and tubes in gaps between the protrusions.

7. The assembly of claim 5, wherein the circumferential hollow tubes have walls of a thickness to withstand up to about 15 kips per square inch before collapsing.

8. The assembly of claim 5, wherein the protrusions extend a distance from the inner surface of the wellhead housing, and the hollow tubes have diameters, and wherein the distance that the protrusions extend is greater than the diameters of the hollow tubes.

* * * * *